US007042695B2

(12) United States Patent
Przytulla et al.

(10) Patent No.: US 7,042,695 B2
(45) Date of Patent: May 9, 2006

(54) PLASTIC CONTAINER WITH ELECTRIC DISSIPATION CAPABILITY

(75) Inventors: Dietmar Przytulla, Kerpen (DE); Ernest Van Den Boogerd, Nieuwendijk (NL); Alain Yves Marie Dirven, Oosterhout (NL)

(73) Assignee: Mauser-Werke GmbH & Co. KG, Brühl (DE)

( * ) Notice: Subject to any disclaimer, the term of this patent is extended or adjusted under 35 U.S.C. 154(b) by 16 days.

(21) Appl. No.: 10/501,106

(22) PCT Filed: Apr. 23, 2003

(86) PCT No.: PCT/EP03/04225

§ 371 (c)(1),
(2), (4) Date: Jul. 8, 2004

(87) PCT Pub. No.: WO03/093116

PCT Pub. Date: Nov. 13, 2003

(65) Prior Publication Data

US 2005/0082076 A1 Apr. 21, 2005

(30) Foreign Application Priority Data

Apr. 23, 2002 (DE) ..... 202 06 423 U

(51) Int. Cl.
*H05F 3/00* (2006.01)

(52) U.S. Cl. ..... 361/215

(58) Field of Classification Search ..... 361/215
See application file for complete search history.

(56) References Cited

U.S. PATENT DOCUMENTS 3,115,281 A * 12/1963 Somme ..... 222/184
4,005,813 A * 2/1977 Johnston ..... 228/184
4,540,191 A * 9/1985 Hoch ..... 280/834
5,232,120 A * 8/1993 Dunken et al. ..... 220/661
5,634,561 A * 6/1997 Pfeiffer ..... 206/719
5,971,185 A * 10/1999 Schutz ..... 220/1.6
5,979,685 A * 11/1999 tz ..... 220/1.6
6,050,437 A * 4/2000 Schutz ..... 220/4.12
6,156,969 A * 12/2000 Schutz ..... 174/17 LF
2002/0144925 A1 * 10/2002 Busch ..... 206/524.2

FOREIGN PATENT DOCUMENTS

DE 29 14 478 A 10/1980
DE 38 34 986 A 4/1990
DE 100 42 297 A 3/2002
DE 201 07 962 U 6/2002
DE 101 15 780 A 10/2002
EP 0 386 764 B1 8/1993
EP 1 139 476 A2 10/2001

(Continued)

*Primary Examiner*—Ronald Leja
(74) *Attorney, Agent, or Firm*—Henry M. Feiereisen

(57) ABSTRACT

The invention relates to a multi-layer plastic container (10) for the storage and transport of materials in particular with an explosion risk, comprising at least two layers of plastic, whereby the inner layer (14) is not electrically conducting and the outer layer (12) is electrically conducting. According to the invention, an electrostatic charging of the plastic container or/and the inner filled material with a risk of explosion may be avoided, whereby a permanent electrical connection between the inner packed material and the base on which the plastic container (10) is mounted is provided which guarantees a secure discharge of electrostatic charging of the container body or the packed material to the base.

18 Claims, 10 Drawing Sheets

FOREIGN PATENT DOCUMENTS

| | | | |
|---|---|---|---|
| GB | 2 219 270 | A | 12/1989 |
| JP | 57-019971 | A | 2/1982 |
| JP | 6-188008 | A | 8/1994 |
| WO | WO 02/053475 | | 7/2002 |

* cited by examiner

PLASTIC CONTAINER WITH ELECTRIC DISSIPATION CAPABILITY

BACKGROUND OF THE INVENTION

The invention relates to an industrial packaging container of plastic (HD-PE) such as e.g. a bunged drum, a lidded drum, a jerrican, or an inner container for a pallet container (IBC). Such packaging containers or drums are used for storage and transport in particular of combustible or explosive liquid or solid contents.

A bunged drum typically includes a cylindrical drum wall, a disk-shaped drum bottom end, and a respective drum top end. Provided in the transition zone between drum wall and drum top is a circumferential carrying and transport ring (handling ring=L-ring). The drum top end has formed therein at least one bung opening which is arranged in a recessed bunged housing (bung depression) and has an upright bung fitting. The upper open drum body of a lidded drum is closed by an attached drum lid and tension ring. The drum lid may also be provided with bung openings. Jerrican and IBC inner container are closed by respective screw caps.

Any packaging container useful for storage and transport of especially hazardous liquid contents must be inspected by an official authority and approved. The container has to meet certain requirements and exhibit, for example, sufficient stacking stability, drop resistance and tightness.

When using the packaging container for combustible contents or liquids, care should be taken to avoid electric charge buildup and spark formation during manipulation of the container, in particular during filling or emptying, so as to prevent explosion of evaporating gas mixtures.

SUMMARY OF THE INVENTION

It is therefore an object of the present invention to provide an industrial packaging container of the afore-stated type for storage and transport of especially combustible contents (liquids), having a particular construction to allow use in explosive areas.

This object is attained by a packaging container (electrically dissipative plastic container) in such a manner that an electric connection is established between the inside content and the bottom end, upon which the packaging container rests, so that an explosive electrostatic charge buildup of the content and/or the container body is prevented and the electrostatic charge buildup is securely transmitted into the bottom end.

The dependent claims set forth further advantageous structural modifications of the invention.

The construction of the dissipative plastic container is characterized in particular by:

- realizing the electroconductive connection between the liquid content and the conductive outer container layer via a permanently installed conductive dissipator rod and via a screwed, also conductive, bung plug in which the dissipator rod is inserted and which, when screwed in, is in electric contact with the conductive outer side of the drum body,
- making the length of the dissipator rod longer by about between 3% and 30% than the height of the container so that the dissipator rod extends from the conductive bung plug to the most remote area of the container bottom end,
- realizing the electric connection between the liquid content inside and the electroconductive outer side of the container body via a special further screw plug which is also conductive and screwed into the bottom end of the container body,
- realizing the electric connection between the liquid content inside and the electroconductive outer side of the container body via a special plug which is made of conductive plastic and welded or injection-molded into the bottom end of the container body,
- realizing the electric connection between the liquid content inside and the electroconductive outer side of the container body via at least one wall dimple provided, preferably, in the bottom end of the container body, whereby the outer layer made of conductive plastic is formed into the interior of the drum body and is brought into contact with the liquid content.

BRIEF DESCRIPTION OF THE DRAWING

Further important and essential features of the introduced novel packaging container according to the invention are shown in the drawings.

Exemplified embodiments of the invention will now be described in detail with reference to the drawings, in which.

DETAILED DESCRIPTION OF PREFERRED EMBODIMENTS

Figure 1:
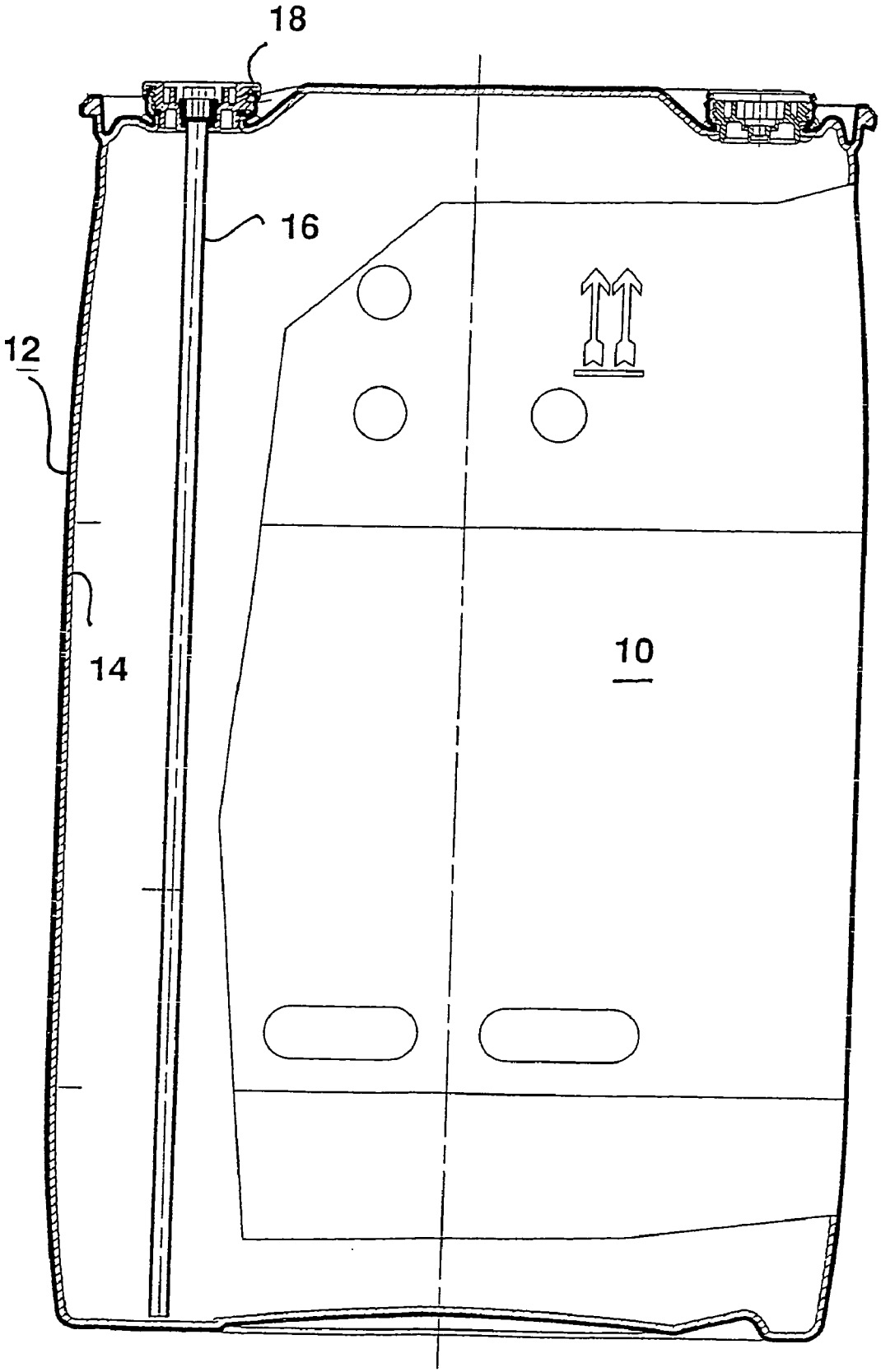
FIG. 1 shows a bunged drum of plastic in accordance with the invention.

FIG. 1 shows, by way of example, a two-layer 220 liter plastic drum (220 liter L-ring drum PLUS, electrically dissipative) made by a coextrusion blow molding process and protected electrostatically by a conductive outer plastic layer 12 and an electric connection between the liquid (content) and the conductive outer layer. The inner, non-conductive plastic layer 14, which is in contact with the content, is made of neutral plastic (HD-PE). The drum outside (e.g. black outer plastic layer through addition of soot) is made across the entire surface thereof of a conductive plastic (surface resistance 1.1 kΩ to 1.4 kΩ). In this way, a secure electric connection between the liquid inside and the electroconductive outside of the drum body is established. The electroconductive connection between the liquid and the conductive outer container layer is realized by a permanently installed conductive dip tube 18 as electric dissipator rod and via a screwed, also conductive, bung plug 18 in which the dip tube is inserted and which, when screwed in, is in contact with the conductive outer side of the drum body (measured resistance to ground smaller 100 kΩ at 10 V). The dip tube should hereby touch the drum bottom, and for that purpose may be provided at the lower end, preferably with a yielding, bellow-like tube tip to ensure that the dip tube extends in any case to the inner drum bottom.

Figure 2A:
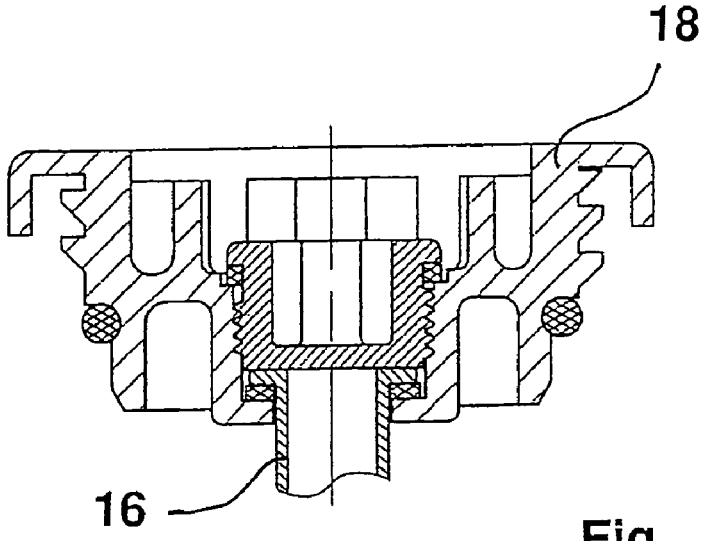
FIG. 2*a* shows a bung plug with attached dip tube.

FIG. 2*a* shows a bung plug 18 of electroconductive plastic in which the dip tube 16 is inserted.

Figure 2B:
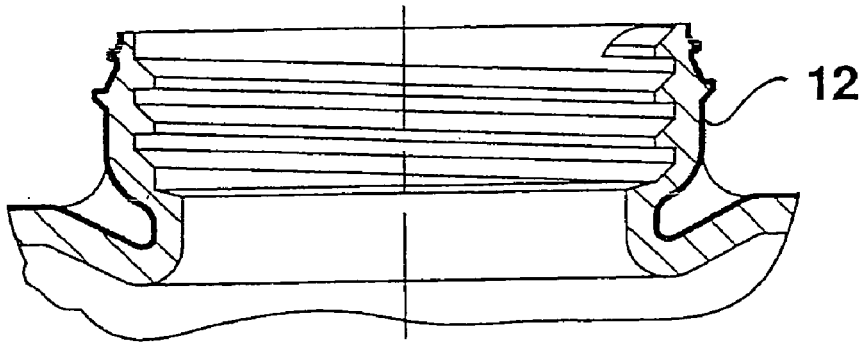
FIG. 2*b* shows a bung plug of the bunged drum according to FIG. 1.
Figure 2C:
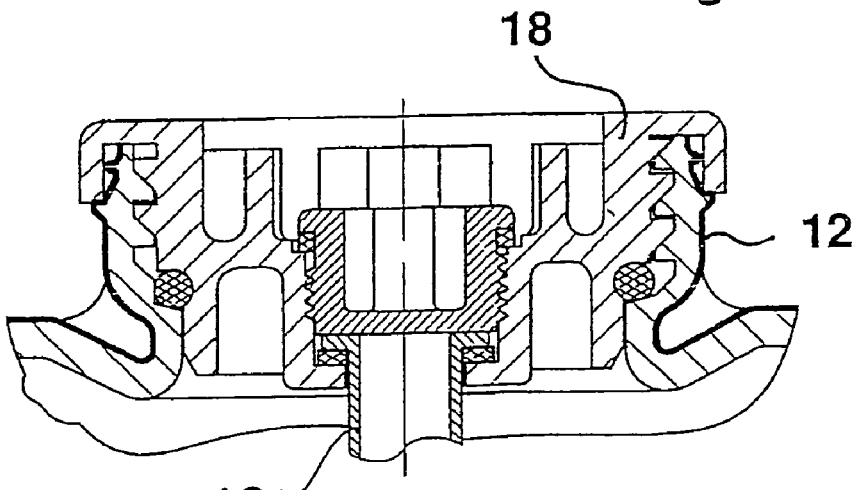
FIG. 2*c* shows the bung plug screwed into the bung fitting.

FIG. 2*b* shows an enlarged view of the bung fitting of the plastic drum 10 to illustrate the extension of the outer electroconductive layer 12 of the drum wall up to the upper rim of the bung fitting. As a result—as shown in FIG. 2*c*—an electroconductive connection is ensured from the dip tube 16 to the outer layer 12 of the container wall, when the bung plug 18 is screwed on.

Figure 3A:
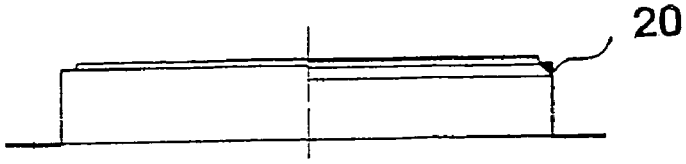
FIG. 3*a* shows a sealing cap for a bung plug.
Figure 3B:
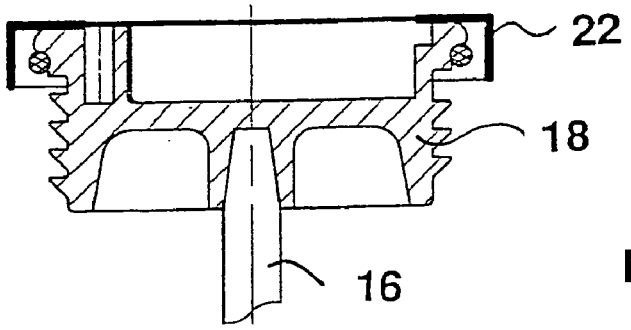
FIG. 3*b* shows a bung plug with attached sealing cap and inserted dip tube.

FIG. 3*a* illustrates a metallic cover cap 20 (=sealing cap), and FIG. 3*b* shows a bung plug with inserted dip tube 16, designed here as round bar of conductive plastic solid material, and attached clinch ring 22 (=contact ring).

Figure 3C:
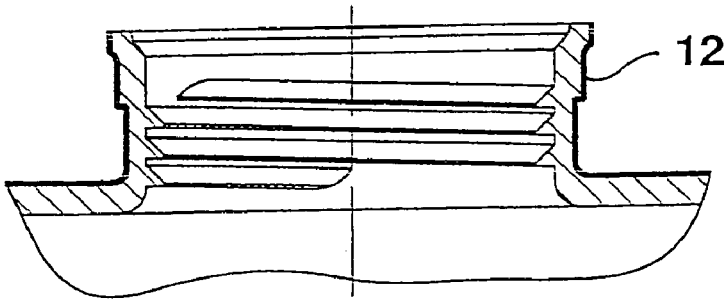
FIG. 3*c* shows another bung fitting.
Figure 3D:
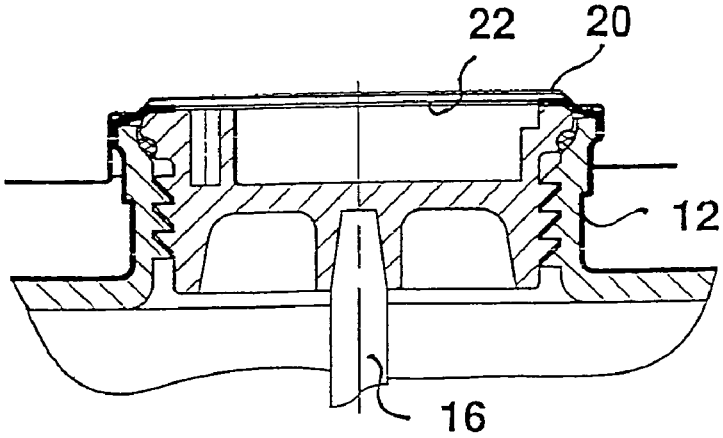
FIG. 3*d* shows the bung plug according to FIG. 3*b*, screwed into the bung fitting.

FIG. 3*c* shows the pertaining bung fitting, while FIG. 3*d* shows all components being assembled. The clinch ring 22 permanently secures the screwed bung plug 18 with dip tube 16 in the bung fitting of the drum, with the clinch ring 22 and the attached cover cap 20 establishing the electric connection to the conductive outer layer 12 of the drum.

Figure 4A:
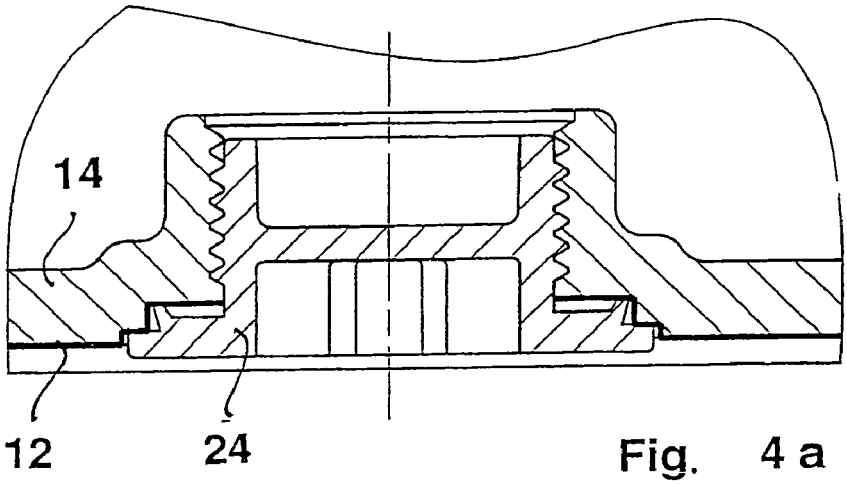
FIG. 4*a* shows a particular bottom bung fitting.
Figure 4B:
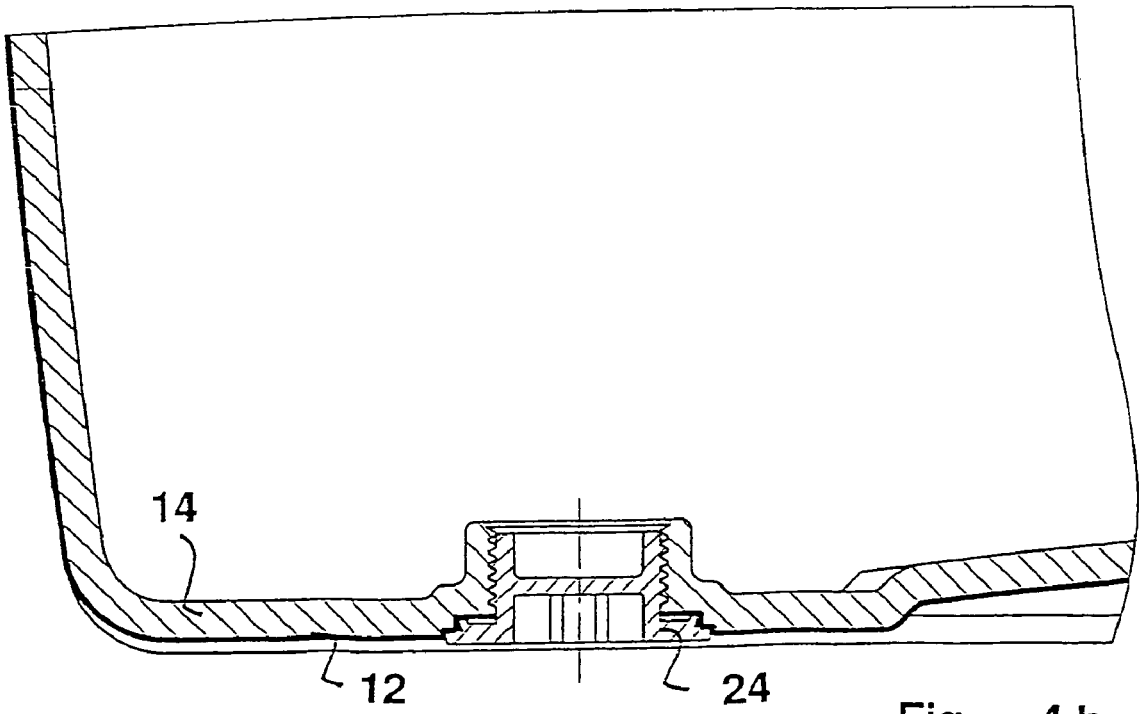
FIG. 4*b* shows an enlarged illustration of the bottom bung fitting screwed into the drum bottom end according to FIG. 4*a*.

FIG. 4*a* and FIG. 4*b* show a modification of the invention in which the electric connection between the liquid inside and the electroconductive outer side 12 of the container body is realized by a particular further bottom bung plug 24 which is screwed into the bottom end of the container body and also made conductive (measured resistance to ground about 450 kΩ at 10 V).

Figure 5A:
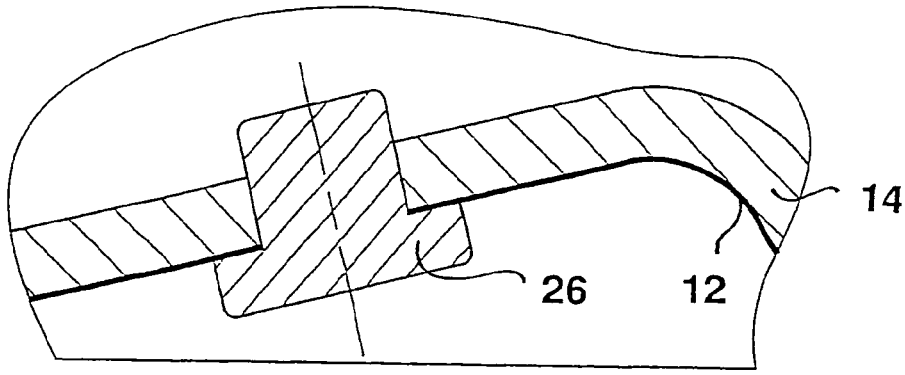
FIG. 5*a* shows a particular bottom plastic plug.
Figure 5B:
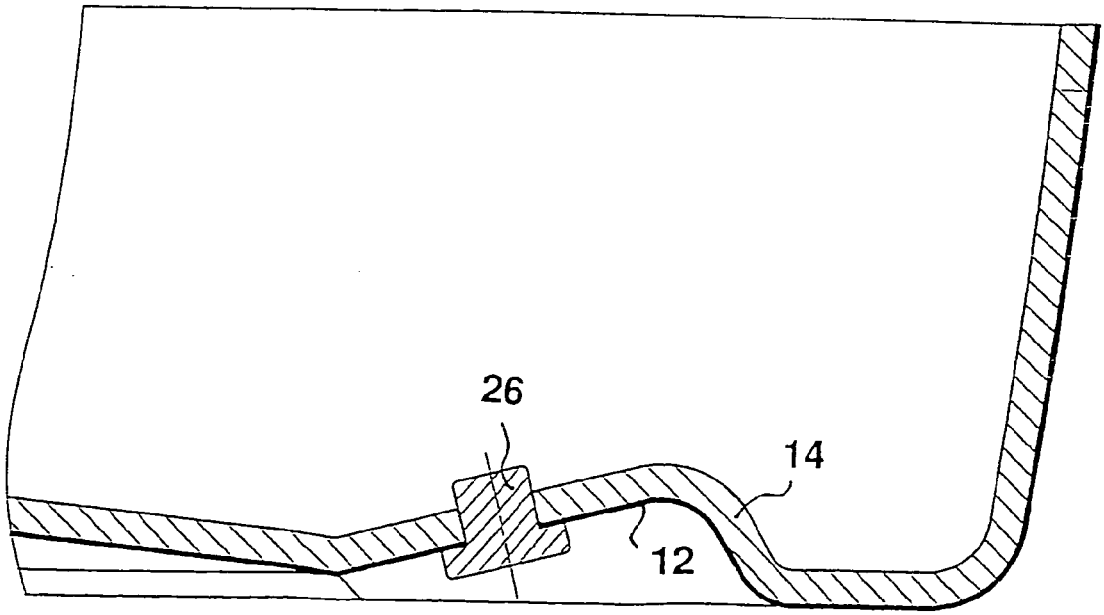
FIG. 5*b* shows the plastic plug according to FIG. 5*a*, inserted in the drum bottom end.

According to another variation—illustrated in FIG. 5*a* and FIG. 5*b*—the electric connection between the liquid inside and the electroconductive outer side 12 of the container body is realized by a special plug 26 made of conductive plastic (measured resistance to ground about 100 kΩ at 10 V) and welded into the bottom end of the container body.

Figure 6A:
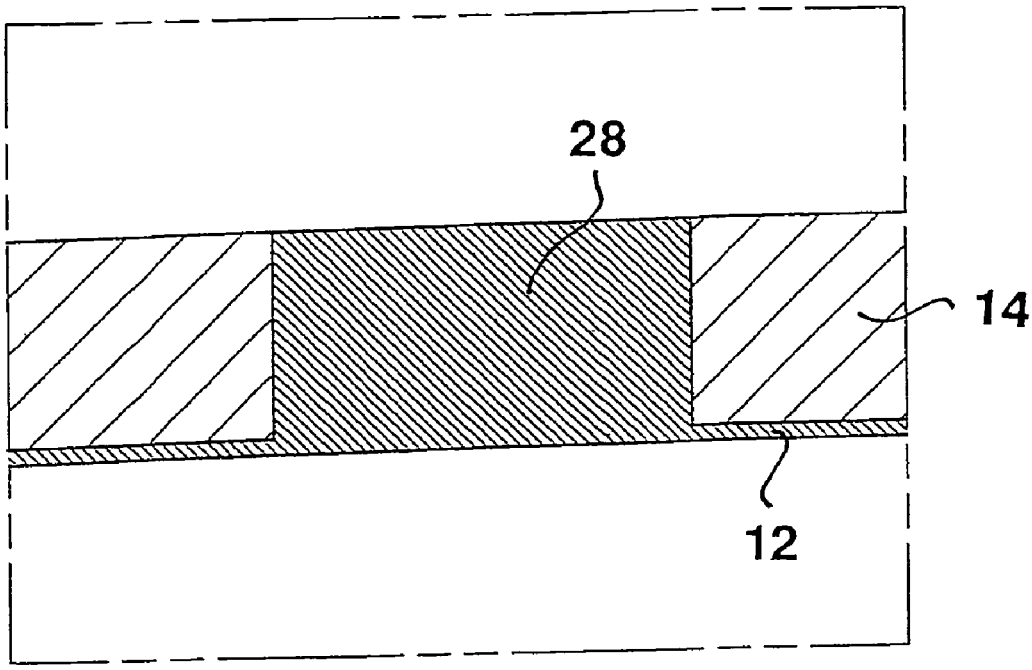
FIG. 6*a* shows a plastic plug connected with an outer layer.
Figure 6B:
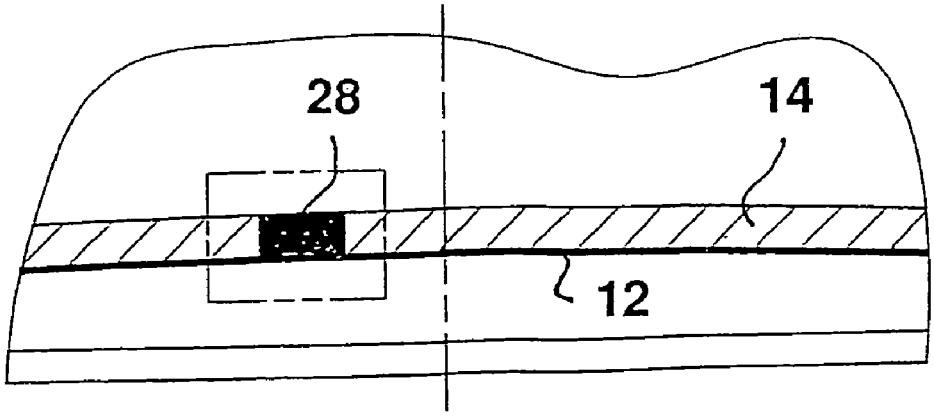
FIG. 6*b* shows an enlarged illustration of the plastic plug according to FIG. 6*a*, disposed in the drum bottom end.

According to another variation—illustrated in FIG. 6*a* and FIG. 6*b*—the electric connection between the liquid inside and the electroconductive outer side 12 of the drum body is realized by a special plug 28 made of conductive plastic and injection-molded into the bottom end of the container body The conductive plastic of the plug 28 is made of the same material as the outer layer 12 of the bunged drum.

Figure 7A:
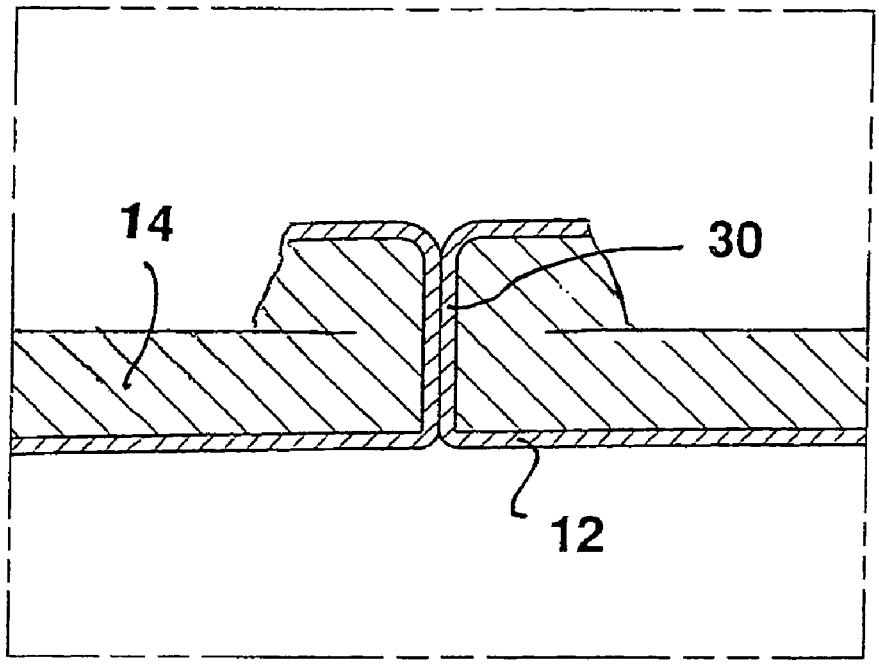
FIG. 7*a* shows a particular configuration of the outer plastic layer guided inwardly.
Figure 7B:
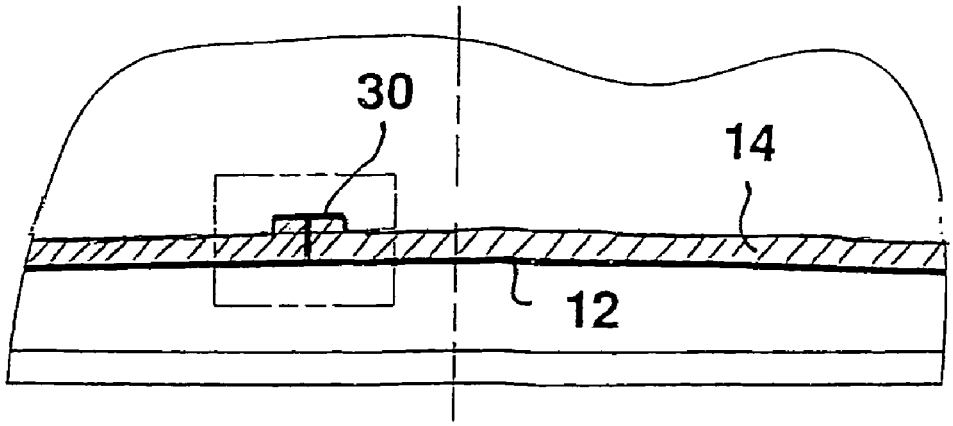
FIG. 7*b* shows an enlarged illustration of the inwardly guided outer plastic layer according to FIG. 7*a*, and disposed in the drum bottom end.

According to another variation—illustrated in FIG. 7*a* and FIG. 7*b*—the electric connection between the liquid inside and the electroconductive outer side 12 of the container body is realized by at least one wall dimple 30, provided preferably in the bottom end of the container drum, whereby the outer layer 12, which is made of conductive plastic, is formed into the interior of the container body and brought into contact with the liquid content. The wall dimple 30 may be realized in the blow mold by means of a particular mandrel (=mold slide).

Figure 8:
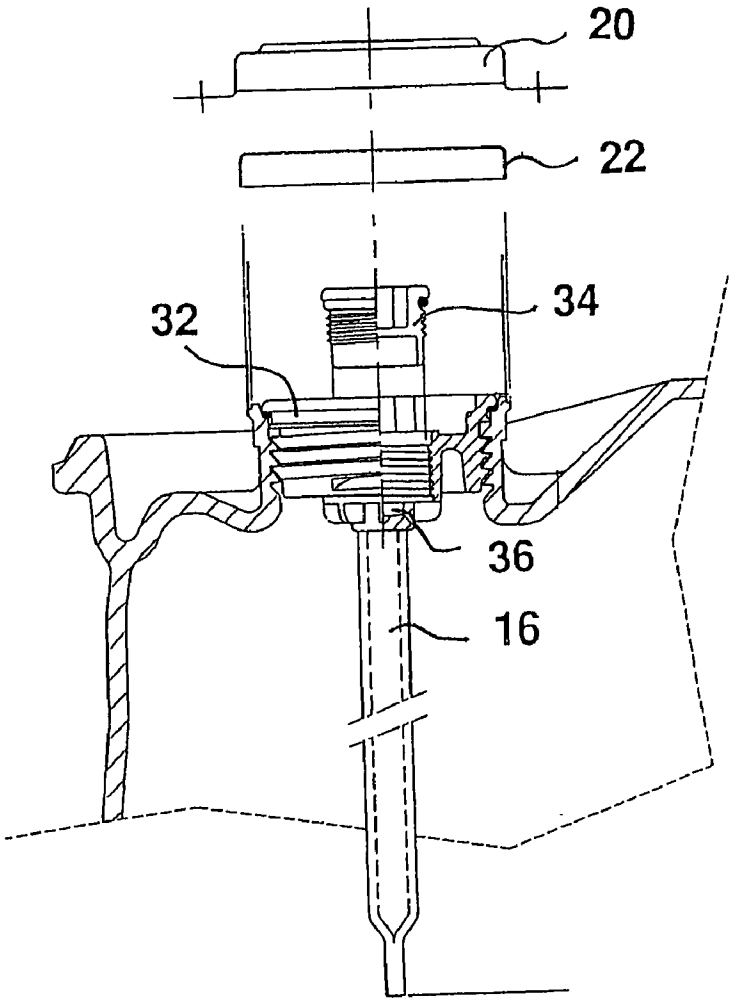
FIG. 8 is a partial section view in the drum top end/bung zone.

FIG. 8 shows a particular venting bung plug 32 with vent openings 36 and with suspended dip tube 16, with the venting of the drum being implemented by removing an inner smaller screw plug 34. Emptying of the drum requires only removal of the sealing cap 20 (original closure), while the clinch ring 22 remains upon the bung fitting or bung plug.

Figure 9:
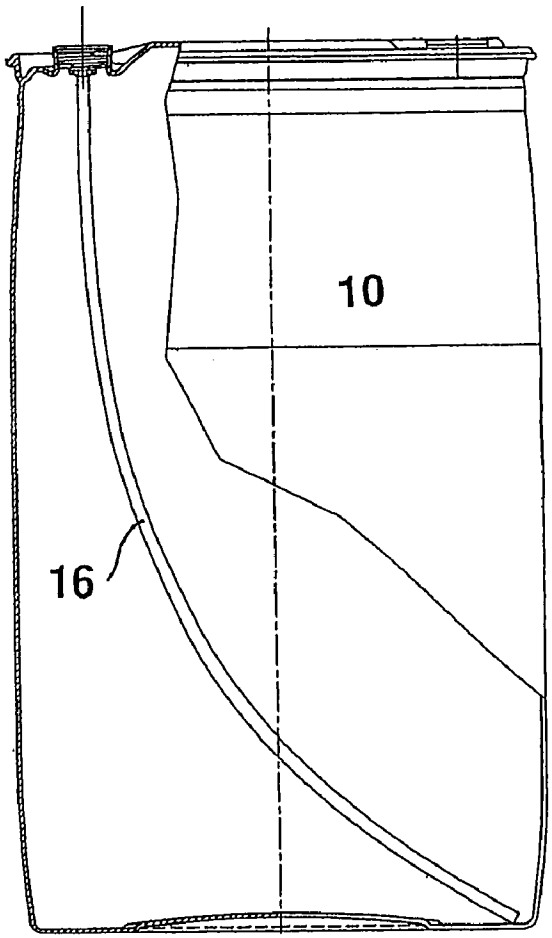
FIG. 9 is a partial section/side view of another bunged drum.

FIG. 9 depicts a particular configuration of the dip tube 16. The dip tube 16 or the dissipator rod is designed longer by about between 3% and 30% than the height of the container so that the dissipator rod is able to extend from the conductive bung plug to the most remote region of the container bottom end.

Figure 10:
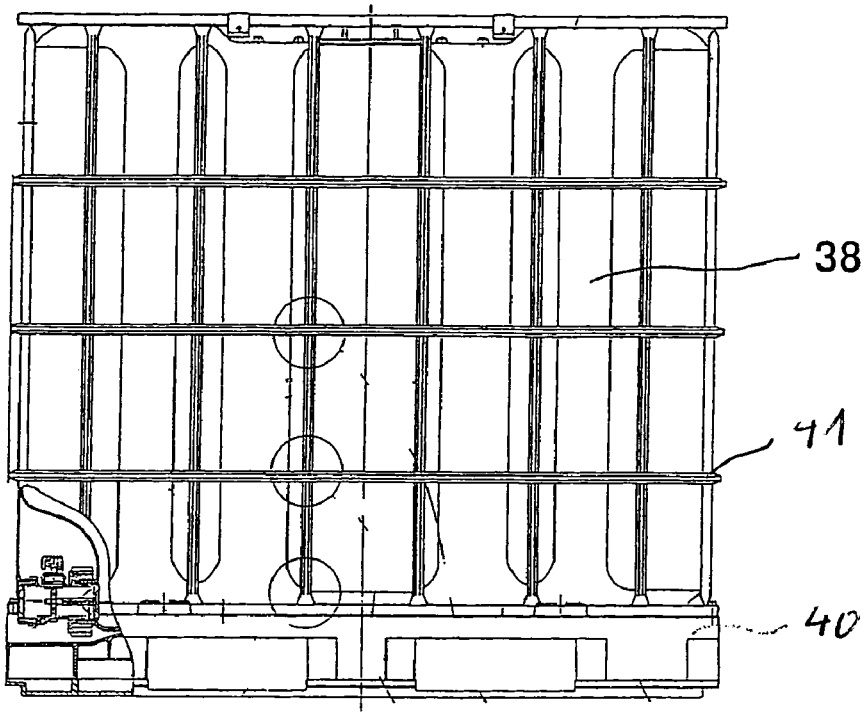
FIG. 10 is a side view of a pallet container according to the invention.
Figure 11:
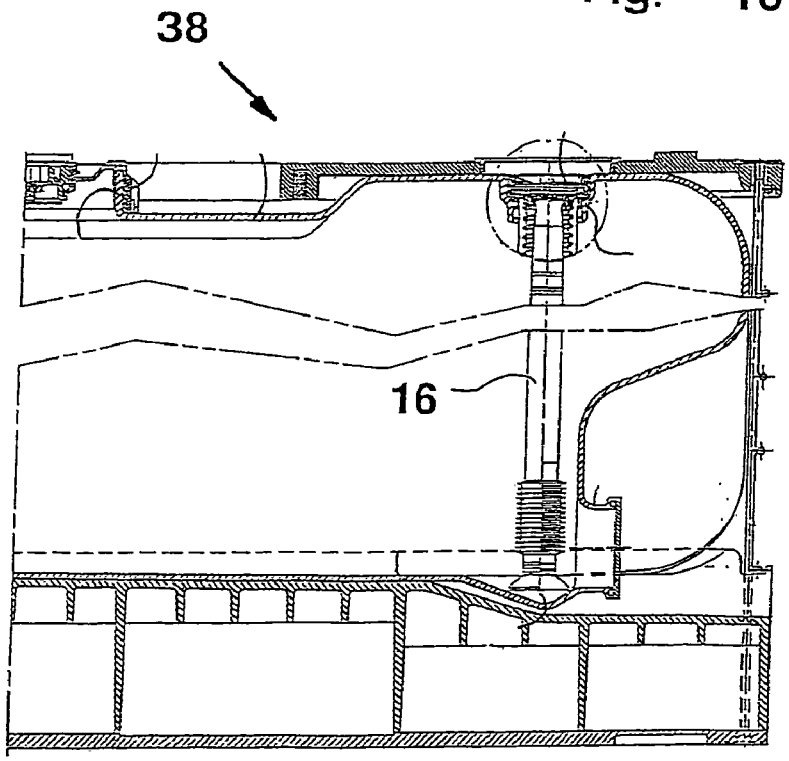
FIG. 11 is partial section view of a pallet container.

FIG. 10 shows a pallet container (IBC) 38 having a thin-walled plastic inner container 10 configured with the features according to the invention and placed upon a bottom pallet 40 The container 10 is surrounded by a cage 41 which is secured to the bottom pallet 40. As further shown in FIG. 11, the electrically conducting dip tube 16 is equipped here with a bellow-like inner tip to ensure a secure contact with the bottom end of the inner container.

Figure 12:
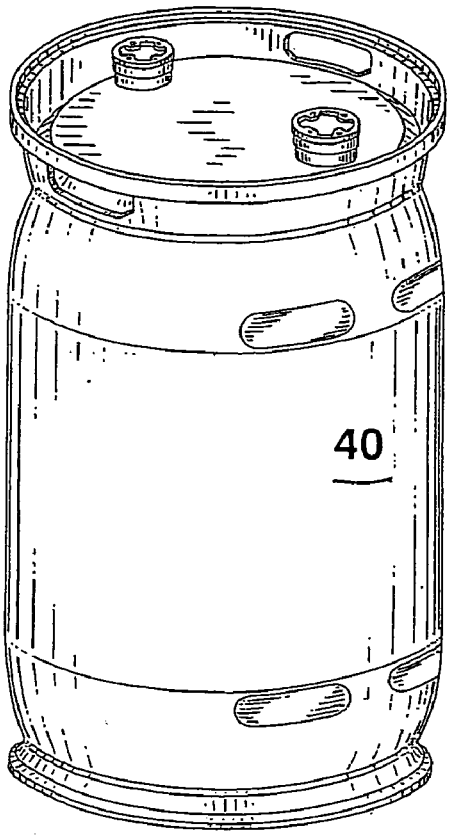
FIG. 12 is a side view of a plastic container according to the invention.
Figure 13:
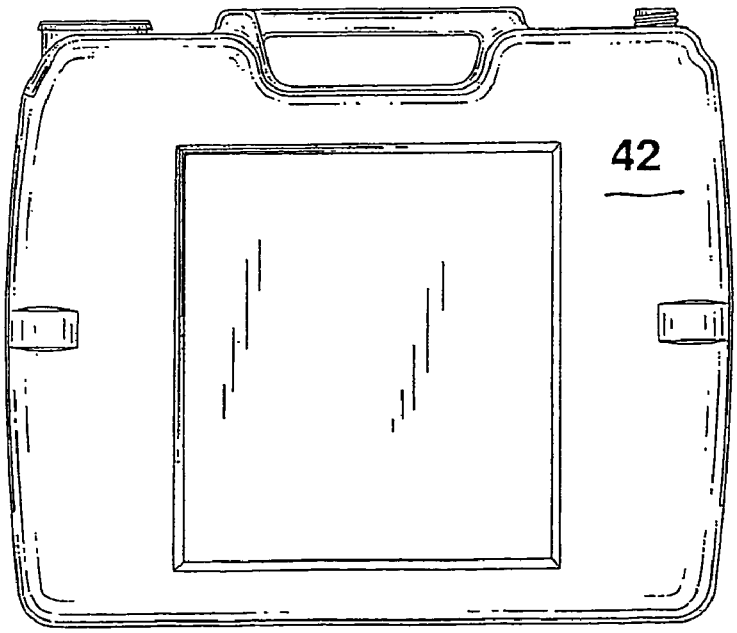
FIG. 13 is a side view of a plastic jerrican according to the invention

FIG. 12 shows as further exemplified embodiment a 60 liter plastic container, and FIG. 13 illustrates a 20 liter plastic jerrican with electrically conducting outer layer.

The container body may also be designed with three layers, with only the outer layer being electroconductive. The inner layer is made of typical natural undyed plastic (new material without color additives and UV stabilizers), while the middle layer may be made of another material, such as, e.g., recovered pellets (material recovered from used plastic containers).

The electroconductive layers or parts are made of electroconductive plastic material, e.g. additives like TiO2, nano-clay, soot, nano-composite, metal fibers or are covered with a conductive varnish.

In case of need, e.g., when the conductive outer layer is blackened with soot, the plastic container may be provided with one or more viewing strips, whereby the viewing strips have preferably limited length and extend only across the vertical wall region.

The measures according to the invention assure a permanent electric connection between the content and the container outside or the support surface upon the ground even in a most detrimental situation, e.g. when the container is half empty or the drum lies on the side. The electrically charge dissipating container should hereby stand across its entire surface with the conductive plastic outer side upon the bottom (ground).

What is claimed is:

1. A plastic container for storage and transport especially of explosive contents, comprising:

a container body having an interior for accommodating a liquid material and including a top end, a bottom end, an inner non-electroconductive plastic container wall and an outer electroconductive plastic container wall, wherein the inner container wall and the outer container wall extend between the top end and the bottom end; and an electric connection established between the material and the outer container wall to prevent an explosive electrostatic charge buildup of the container body or the material and to assure a safe dissipation of the electrostatic charge buildup, said electric connection including an electroconductive bung plug, received in the top end of the container body and electrically contacting the outer container wall, and an electroconductive dissipator rod securely received in the bung plug and having a length which is longer by about between 3% and 30% than a height of the container body so that the dissipator rod extends in the interior of the container body from the bung plug to the bottom end.

2. The plastic container of claim 1, wherein the bung plug is screwed into the top end.

3. The plastic container of claim 1, wherein the electric connection includes a further electroconductive bung plug threadably received in the bottom end of the container body.

4. The plastic container of claim 1, wherein the electric connection includes a further plug which is made of conductive plastic and welded or injection-molded into the bottom end of the container body.

5. The plastic container of claim 1, wherein the electric connection includes at least one wall dimple in the bottom end of the container body, said outer container wall being made of conductive plastic and configured to extend into the interior of the container body for contact with the liquid material.

6. The plastic container of claim 1, wherein the electrically conducting bung plug is designed as venting bung plug having vent openings and a central screw plug of a size which is smaller than a size of the bung plug for controlling a flow through the vent openings.

7. The plastic container of claim 1, and further comprising a clinch ring for securely fixing the bung plug with inserted dissipator rod in a bung fitting of the container body.

8. The plastic container of claim 1, wherein the bund plug with inserted dissipator rod is designed as venting bung plug with vent openings and a screw plug of a size which is smaller than a size of the bung plug and threadably engaged into the bung plug for controlling a flow through the vent openings.

9. The plastic container of claim 1, wherein the dissipator rod has a bung plug distal end which has a bellows-like configuration to ensure an electric contact between the dissipator rod and the bottom end.

10. The plastic container of claim 1, wherein the container body includes a further non-electroconductive plastic container layer between the inner and outer container walls.

11. The plastic container of claim 10, wherein the non-electroconductive plastic container layer is made of pellets recovered from a material of which a spent container body is made.

12. The plastic container of claim 1, wherein the inner container wall is made of natural undyed plastic.

13. The plastic container of claim 1, wherein the inner container wall is made of plastic material containing an additive selected from the group consisting of TiO2, nano-clay, soot, nano-composite, metal fibers.

14. The plastic container of claim 1, wherein the inner container wall is made of plastic material covered with a conductive varnish.

15. The plastic container of claim 1, wherein the inner container wall is made of plastic material blackened with soot.

16. The plastic container of claim 15, further comprising at least one viewing strip.

17. A plastic container for storage and transport of explosive contents, comprising:

a container body having an inner non-electroconductive plastic container wall and an outer electroconductive plastic container wall;

an electroconductive bung plug received atop of the container body and electrically contacting the outer container wall; and an electroconductive dissipator rod securely received in the bung plug and having a length which is longer by about between 3% and 30% than a height of the container body so that the dissipator rod extends from the bung plug to a bottom end of the container body.

18. A pallet container, comprising:

a bottom pallet providing at least one upper surface area;

a double-walled container for storage and transport especially of explosive contents, said container comprising a container body having a bottom for placement upon the bottom pallet, an inner non-electroconductive plastic container wall and an outer electroconductive plastic container wall; an electroconductive bung plug received atop of the container body and electrically contacting the outer container wall; and an electroconductive dissipator rod securely received in the bung plug and having a length which is longer by about between 3% and 30% than a height of the container body so that the dissipator rod extends from the bung plug to the bottom of the container body; and a cage-like bar frame closely surrounding the container and securely connected to the bottom pallet.

* * * * *